United States Patent [19]

Bagby et al.

[11] 4,258,655

[45] Mar. 31, 1981

[54] ELECTROSTATIC SPRAY APPARATUS

[75] Inventors: Thomas L. Bagby, Washington; Gary L. Demeny, Delavan; Robert G. Smead, St. Charles, all of Ill.

[73] Assignee: Caterpillar Tractor Co., Peoria, Ill.

[21] Appl. No.: 18,019

[22] Filed: Mar. 6, 1979

Related U.S. Application Data

[63] Continuation of Ser. No. 678,844, Apr. 21, 1976, abandoned.

[51] Int. Cl.[3] ..... B05B 1/04; B05B 5/02

[52] U.S. Cl. ..... 118/635; 239/707

[58] Field of Search ..... 361/229, 227, 228; 239/708, 3, 690, 707, 590.3; 118/621, 629-635

[56] References Cited

U.S. PATENT DOCUMENTS

| | | | |
|---|---|---|---|
| 2,890,383 | 6/1959 | Croskey et al. | 118/621 |
| 2,959,353 | 11/1960 | Croskey et al. | 118/621 |
| 3,000,576 | 9/1961 | Levey et al. | 239/590.3 |
| 3,169,883 | 2/1965 | Juvinall | 427/33 |
| 3,376,156 | 4/1968 | Whitaker et al. | 239/708 X |
| 3,613,993 | 10/1971 | Gourdine et al. | 239/3 |
| 3,625,424 | 12/1971 | Mantica | 239/708 |
| 3,677,470 | 7/1972 | Probst et al. | 239/3 |
| 3,700,168 | 10/1972 | Ferrant | 239/3 |
| 3,731,145 | 5/1973 | Senay | 239/708 X |
| 3,746,253 | 7/1973 | Walberg | 239/705 |
| 3,767,115 | 10/1973 | Kosinski et al. | 239/3 |
| 3,774,844 | 11/1973 | Walberg | 239/695 |
| 3,837,573 | 9/1974 | Wagner | 118/621 |
| 3,937,401 | 2/1976 | Luderer et al. | 118/621 |

OTHER PUBLICATIONS

*Products Finishing*, Jan., 1976, "Electrostatic Spray of Water-Borne Paints", Gerard H. Poll, Jr., pp. 34-41.

*Primary Examiner*—Morris Kaplan

*Attorney, Agent, or Firm*—Charles E. Lanchantin, Jr.

[57] ABSTRACT

A system and method for electrostatic coating of articles with paint particularly suited for coating irregular surfaces from a substantial distance. Water-borne conductive paint may be handled from an electrically grounded supply. Plural paint particle charging mechanisms are established by a DC potential applied to an electrode physically divorced from the paint stream. The articles being coated are electrically charged.

15 Claims, 7 Drawing Figures

ELECTROSTATIC SPRAY APPARATUS

This is a continuation of application Ser. No. 678,844, filed Apr. 21, 1976, now abandoned.

This invention relates to electrostatic painting of articles, particularly articles with irregular surfaces, and preferably using water-borne paint.

Electrostatic painting systems typically require that the paint atomizing and charging apparatus be in close proximity to the grounded article being coated. Distances less than two feet (0.6 m) are common. The painting of large irregular surfaces requires complex movement of the apparatus and cannot practically be automated. Moreover, environmental restrictions on the industrial use of organic solvent paints have led to efforts to substitute water-borne paints that have a high electrical conductivity and require special precautions for use with electrostatic coating apparatus. The apparatus and method disclosed herein provides a solution to both problems.

Prior electronic systems using water-borne paint have been of two types. In one, the entire paint system, e.g., the bulk paint supply, paint pump and delivery conduits, is maintained at the electrostatic charging potential, as 50 kv to 100 kv. The charged paint system must be protected from access by the operator, complicating servicing of the supply, replenishment of paint and changing of paint color. Also, the electrical energy stored in the capacity of the charged paint system presents a danger of fire or explosion in the event of a short circuit. Another system grounds the paint supply and spray gun while maintaining the article being coated at an electrical potential of the order of 100 kv. The paint particles are not electrically charged on formation at the gun and the higher efficiency of paint deposition associated with charging the paint particles is not achieved.

In accordance with the invention, the paint supply and atomizing gun are grounded. The paint is atomized into particles, some of which are charged positively, some negatively and others are uncharged.

In the preferred system an electrode is mounted on the paint atomizing gun, physically spaced from the paint stream, and connected with a high voltage source. A first electric field is established between the nozzle and the electrode, and a corona discharge at the electrode tip provides separate and distinct charging mechanisms producing multiple species of charged particles. The articles to be coated are insulated from ground and connected with a high voltage source, which establishes a second electric field. Particles of polarity opposite that of the article are attracted to it. Other particles coat surface areas which are hidden or shielded and would not be adequately covered, with prior painting systems.

One feature of the invention is the provision of a system for electrostatic coating of an article with a water-borne conductive paint in which a stream of paint is delivered from a source to the atomizing gun nozzle. A charging electrode spaced from the paint stream has an end portion spaced a preselected distance from the atomizing means. A first source of DC potential is connected to the charging electrode establishing a zone of ions through which some of the particles pass. A second source of DC potential is connected with the article to be coated.

Another feature is the provision of means for mechanically projecting the particulate paint toward the article and into the electric field established by the charge thereon.

A further feature is that the system is capable of coating irregularly shaped articles having recessed areas and sharp edges.

An additional feature is that the system will effectively coat very large objects.

A further feature is that in a specific system the charging potential of the electrode is of the order of 15 kv, the potential applied to the article is of the order of 100 kv and the minimum spacing between the atomizing means and the article is of the order of 16 inches.

Yet another feature is that the article being coated and the atomizing means are located within a grounded conductive enclosure.

And a further feature is means for electrostatically coating an article with paint which comprises atomizing the paint, imparting an electric charge of one polarity to some of the particles, imparting an electric charge of the opposite polarity to other of the particles and electrically charging the article to be coated.

Further features and advantages will readily be apparent from the following specification and from the drawings, in which.

Figure 1:
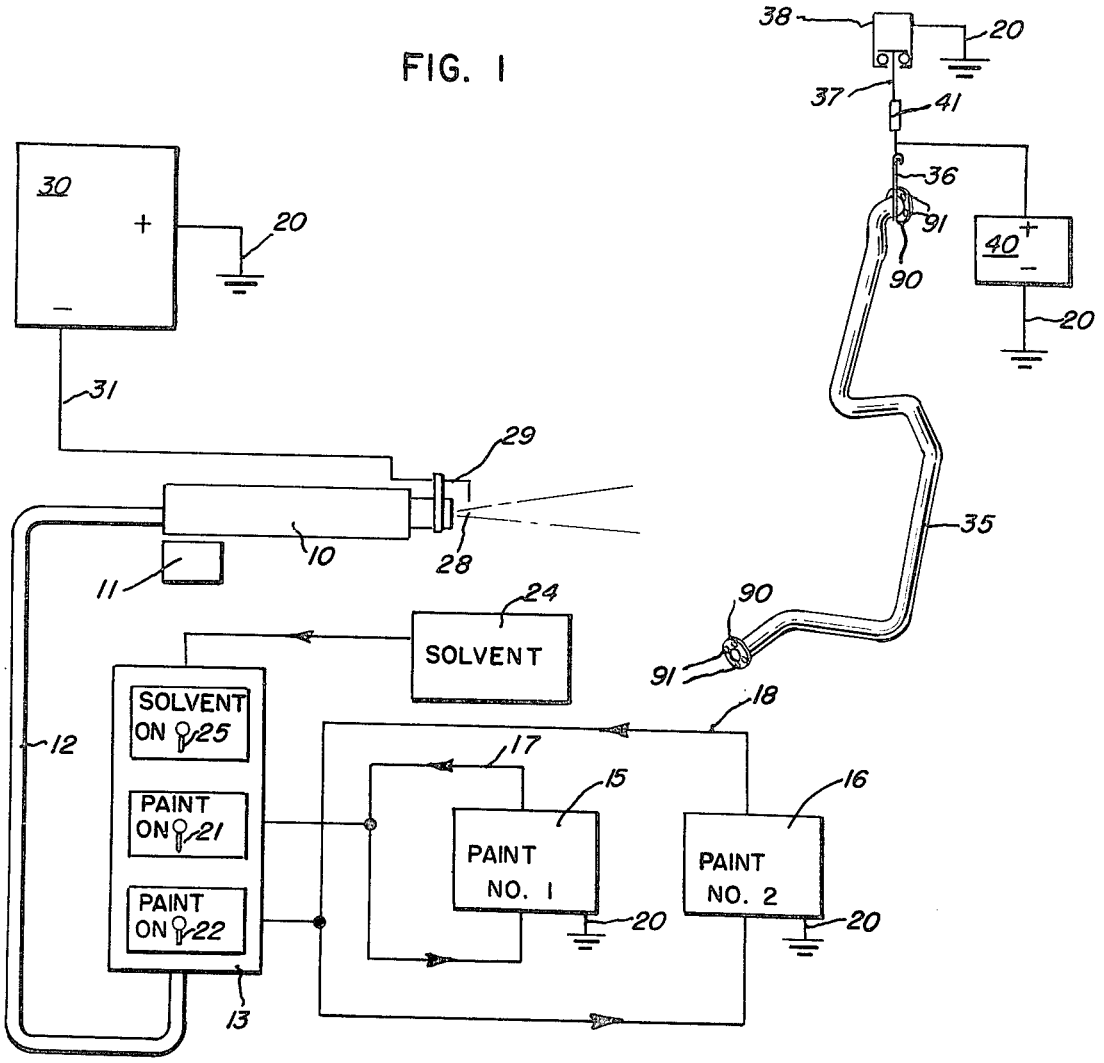
FIG. 1 is a diagrammatic illustration of a coating system embodying the invention.

In the illustrative system of FIG. 1 a paint atomizing gun 10 is mounted on a support 11, as the arm of a vertical reciprocator. Paint is supplied to the gun 10 through a conduit 12 connected with a paint selector valve 13. The illustrated gun 10 utilizes airless or hydrostatic atomization of paint discharged at high pressure through a small orifice in a nozzle.

Two sources 15 and 16 of paint are illustrated diagrammatically. Each is connected with an inlet of paint selector valve 13 through recirculating paint systems 17, 18, respectively. Paint sources 15, 16 each include a bulk supply of paint and a suitable pump to provide a pressure, as several hundred pounds per square inch, to effect the desired atomization of paint upon discharge from gun 10. The paint sources 15, 16 are preferably grounded as indicated at 20. Valve 13 provides for a selection between paint No. 1 and paint No. 2 by manipulation of valve control elements 21, 22.

A source 24 of solvent is connected with a third inlet of valve 13 and solvent is flushed through the system by actuation of control element 25. With the water-borne paint for which the system is particularly designed, the solvent is water.

Paint is discharged from gun 10 and interacts with the surrounding air, breaking into small particles which form an expanding spray pattern 28 having a cross sectional shape determined primarily by the geometry of the nozzle. The particles are mechanically projected along the gun axis toward the article being painted. The size of the paint particles and the extent of the concentrated pattern along the gun axis are established by such factors as the paint viscosity and surface tension, the discharge pressure and the size and shape of the nozzle orifice.

Figure 5:
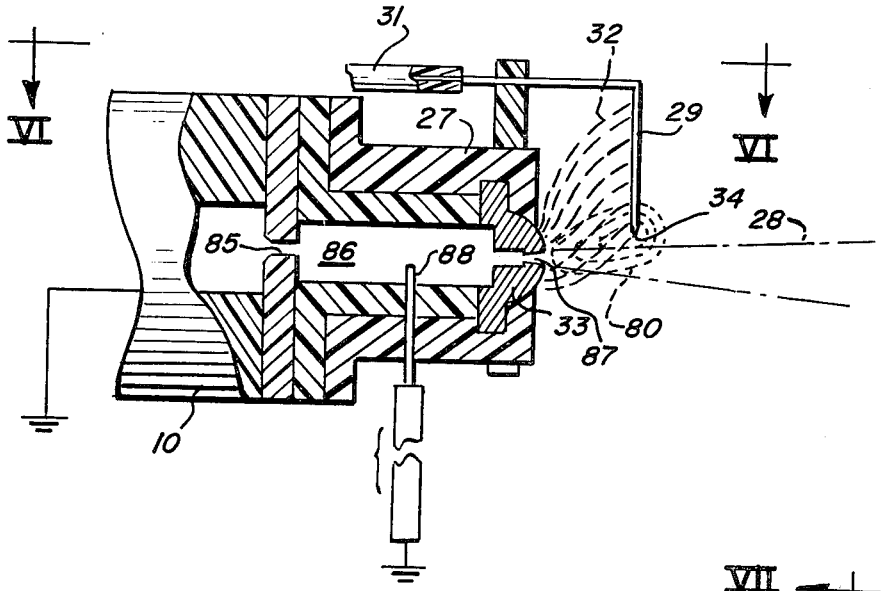
FIG. 5 is a fragmentary sectional view of the end portion of the gun showing the particulate paint, the paint charging electrode and a symbolic representation of the electric field and ionizing zone.
Figure 7:
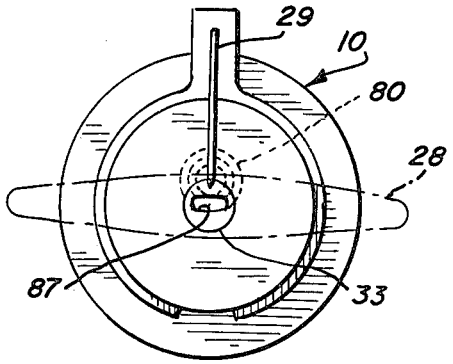
FIG. 7 is an end view of the gun of FIG. 6, taken as indicated by line VII—VII of FIG. 6.

A charging electrode 29 is mounted on a generally annular body or barrel 27 of the gun 10 and extends forwardly of the gun generally parallel with the axis of the paint discharge. As shown in FIGS. 5 and 7, the electrode is spaced immediately above the concentrated particulate paint pattern 28. Electrode 29 is preferably a slender wire having a distal pointed end or tip 34 located adjacent but outside the concentrated paint pattern and oriented generally normal to the axis of the paint discharge. A high voltage DC power supply 30 has its positive terminal grounded at 20 and its negative terminal connected with electrode 29 through a suitable high voltage cable 31 and a current limiting resistor, not shown, establishing an electric field 32 in the region between the end of the electrode and a nozzle 33. The voltage on electrode 29 is sufficient to establish a corona or zone 80 of ions through which some of the paint particles pass.

The paint extends in a solid stream from the source 15 or 16 through system 17 or 18, valve 13 and conduit 12 to gun 10. In the gun, the paint is first partially atomized by passing the solid stream under hydrostatic pressure through a preorifice 85 into an enlarged chamber 86 thereby producing cavitation and partial breakup of the solid stream. The paint is discharged through an orifice 87 in nozzle insert 33 and interacts with the surrounding air, forming small particles. With conductive paint, as the water-borne paint for which the system is intended, if the charging electrode and its associated high voltage circuit are not isolated or divorced from the paint, the paint sources 15, 16 and the paint delivery system would have to be operated at high voltage. This would greatly complicate the system and its use.

Briefly, it is out theory that the paint particles as they are formed at nozzle 33 are charged with a polarity opposite that of electrode 29. Some of the particles pass through the corona 80 where they interact with charged molecules and their initial charge is diminished, neutralized or reversed. The spray of paint particles directed toward the article includes particles with charges of each polarity and with no charge. This results in improved painting of articles with an irregular surface as will be explained in more detail below.

The voltage of power supply 30 applied to charging electrode 29 is sufficient to establish the field 32 between the electrode and the tip of the nozzle 33 to induce a positive charge on the paint particles, and is also sufficient to establish the corona 80 forming negative $O_2$ ions about the electrode tip 34. It is not so great as to cause arcing between the electrode and the conductive paint which forms a stream from gun 10 and conduit 12 to the grounded paint source. In a typical painting system 10, the end portion of charging electrode 29 is in the order of at least 10 mm (about ½ inch) from the tip of nozzle 33 and elevationally immediately above the concentrated particulate paint pattern 28. The electrostatic charging voltage applied thereto is of the order of 15 kv.

The article 35 to be painted is illustrated in FIG. 1 as a length of formed tubing having sharp-edged flanges 90 with holes 91 formed therethrough. The tubing is supported by a hook 36 suspended from a carrier 37 of a grounded overhead conveyor 38. As article 35 is moved on the conveyor through a coating area adjacent gun 10, it is connected with the positive terminal of a second high voltage power supply 40, which has its negative terminal returned to ground 20. Article supporting hook 36 is isolated from the grounded conveyor by an insulator or high value resistor 41. The potentials applied to electrode 29 and article 35 add to establish an electrostatic field for depositing the charged paint particles on the article. An isolation insulator 41 having a resistance such that it passes a current of the order of 100 microamperes from high voltage supply 40 has been found to be satisfactory and to aid in dissipating the charge on the article following the coating operation.

With the gun described above a gun-to-article distance of 0.5 m to 2.5 m (1½ to 8 ft.), and a voltage of 100 kv for source 40 has been found satisfactory. When the article is several times larger than the gun, the electrostatic field produced by the charged part is significantly greater than the field established between a charged gun and grounded article. This field in combination with paint particles charged as described above makes possible coating with heretofore impractical wide gun-to-article distances. The coating action may be explained, in somewhat simplified fashion, by considering the electrostatic field of the gun as a spherical field having a radius r spaced a distance D from the electrostatic field of the article represented by a spherical field having a radius a. As more fully developed in *Introduction to Electromagnetic Fields and Waves* by Dale Corson and Paul Larrain, W. H. Freeman Company, San Francisco, 1962, pps 136–143, the electrostatic field E, at a point midway between the spheres of the above model is:

$$E_1=(4/D^2)(V_g r+V_p a)$$

where $V_g$ is the voltage applied to the sphere of radius r and $V_p$ is the voltage applied to the sphere of radius a, and where $V_g$ and $V_p$ are opposite in polarity.

In the specific system described above, $V_g$ is 15,000 volts and $V_p$ is 100,000 volts. Assigning arbitrary values to the remaining parameters, r=25 mm (1 inch)
a=500 mm (20 inches)
D=1.52 m (5 feet) then $$E_1=87\ V/\text{mm}\ (2200\ V/\text{in})$$

In a conventional system where the article is grounded and a large voltage is applied to the gun, the electrostatic field $E_2$ at a point midway between the gun and article is:

$$E_2\ V_g r\left[\frac{4}{D^2}+aD\left(\frac{D^2}{2}-a^2\right)^{-2}\right];$$

Typically such systems are limited to 100,000 volts for the charge at the gun ($V_g$). Assuming the same values as above for the remaining parameters, $$E_2=6.2\ V/\text{mm}\ (160\ V/\text{in})$$

The electrostatic field strength at a point midway between a charged gun—charged part system ($E_1$) is more than an order of magnitude greater than the field ($E_2$)

between a charged gun—grounded part system, even though the total charge differentials (≈100,000 V) are comparable.

Figure 2:
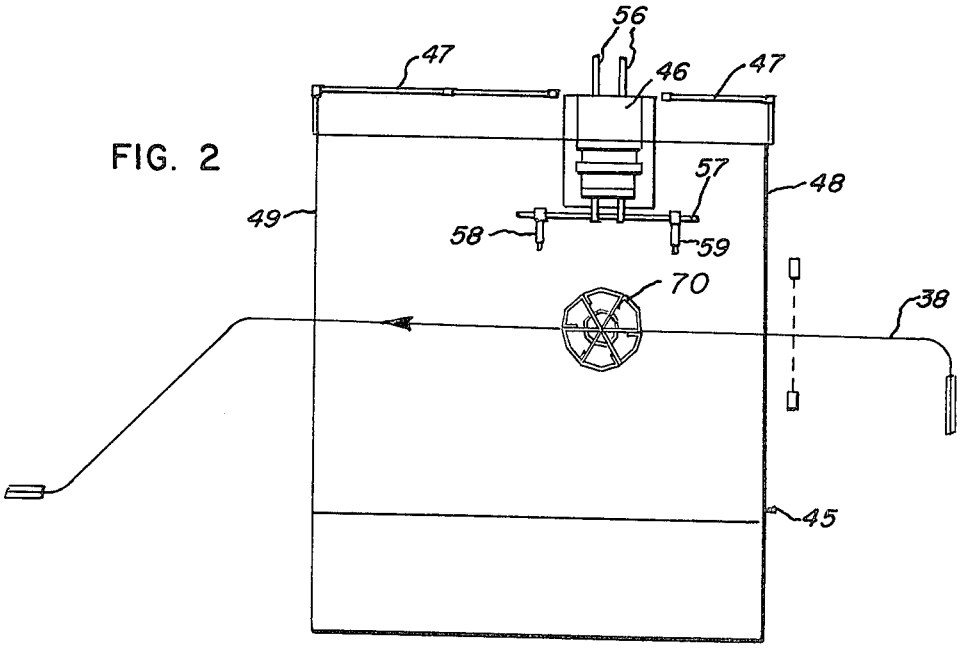
FIG. 2 is a plan view of a paint gun reciprocator and paint booth article conveyor used in the system of FIG. 1.
Figure 3:
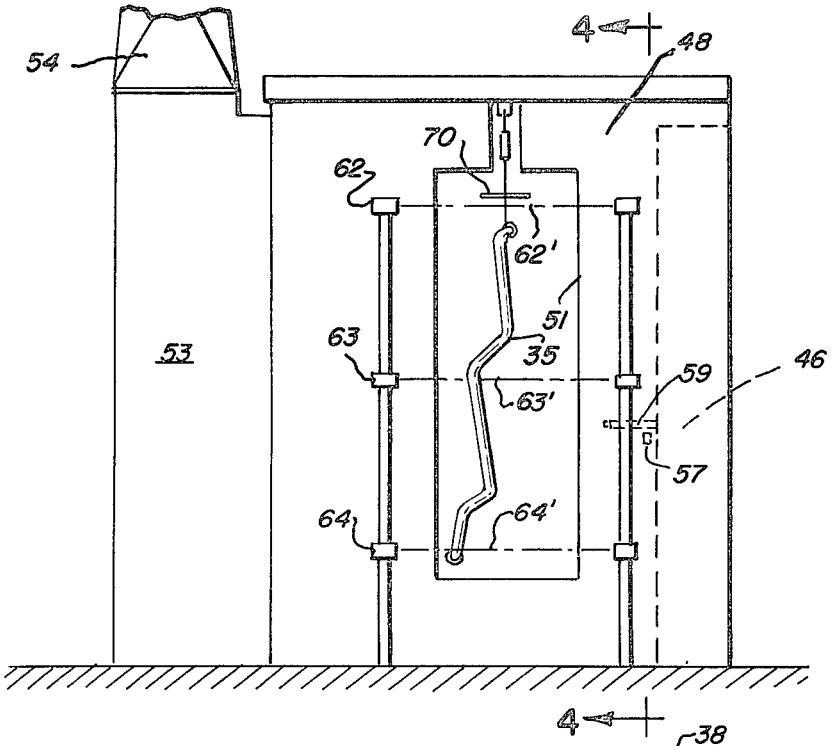
FIG. 3 is an end view of the paint booth looking from the right of FIG. 2.

A typical painting installation incorporating the invention is illustrated in FIGS. 2 and 3. The conveyor 38 extends through a paint booth 45, an enclosure of grounded conductive walls. A paint gun reciprocator 46 is located at the front of the paint booth, which is open except for protective screens 47. The end walls 48, 49 are provided with openings as 51, FIG. 3, through which the articles supported from the conveyor pass. The rear wall of the paint booth incorporates a blower 53 which exhausts air through vent 54. Reciprocator 46 is supported on tracks 56 for movement toward and away from conveyor 38. The reciprocator cross arms 57 has a pair of spray guns 58, 59 mounted thereon. Each may be of the form shown in FIGS. 1, 5 and 6.

At the entrance to the paint booth, FIG. 3, photoelectric detectors 62, 63, 64 are mounted on posts. Light beams 62', 63', 64' extend across the opening 51 to detect the presence and the vertical height of articles carried by the conveyor. A control, not shown, actuates the reciprocator 46 and paint guns 58, 59 in accordance with the presence and size of articles to be painted. The photoelectric sensors may have a light source at one side of the entrance opening 51 and a photocell at the other; or the light source and photocell may be combined at one side with a mirror at the other side, in a retroreflective system.

When an article to be painted enters the paint booth, one or more light beams are broken. Following a time delay which is a function of the speed of the conveyor and the distance between the photoelectric detectors and the reciprocator 46, operation of the reciprocator is initiated. Cross arm 57 and guns 58, 59 are moved through a cycle upwardly from a rest position at the bottom of the reciprocator travel to the top of the reciprocator travel and back down again. During this movement paint flow control valves (not shown) in guns 58, 59 are triggered in accordance with the vertical extent of the articles to be painted as detected by photocells 63, 64.

Articles carried by the conveyors through the paint booth 45 are rotated as they move through the coating zone adjacent guns 58, 59. Suitable apparatus is provided for effecting rotation.

Figure 4:
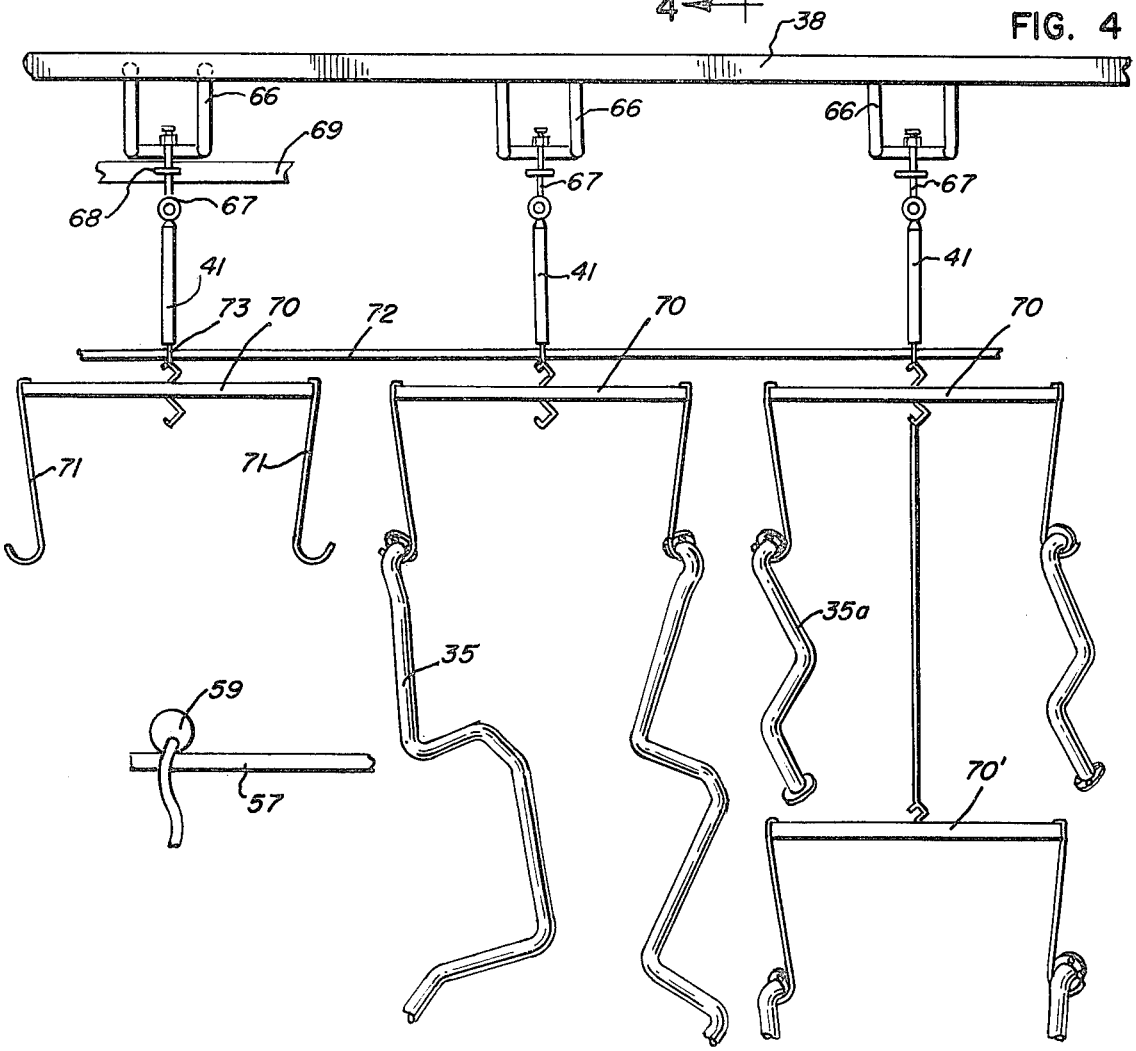
FIG. 4 is an elevation of the reciprocator arm, paint guns and article conveyor taken along line 4—4 of FIG. 3.

As best seen in FIG. 4, wheeled carriers 66 move along conveyor 38. A rotatable link 67 is suspended from each carrier and has a circular disc 68 thereon which engages a drive 69 for rotation of the articles being painted. An insulator or bleeder resistor 41 is suspended from link 67. Generally circular racks 70 are carried from the insulators 41 and have a peripheral rim on which article supporting hooks 71 are hung. The lower ends of the hooks 71 are formed to receive and carry the articles being painted, here shown as formed lengths of tubing 36 with an end flange which engages the hook. Where the lengths of tubing **35*a* are relatively short, a second rack 70' is hung below the upper rack for transporting two sets of articles on a single carrier 66**.

A conductor 72 is connected with high voltage source 40 and is engaged by rack supporting link 73 as the carrier 66 moves through the booth 45.

Figure 6:
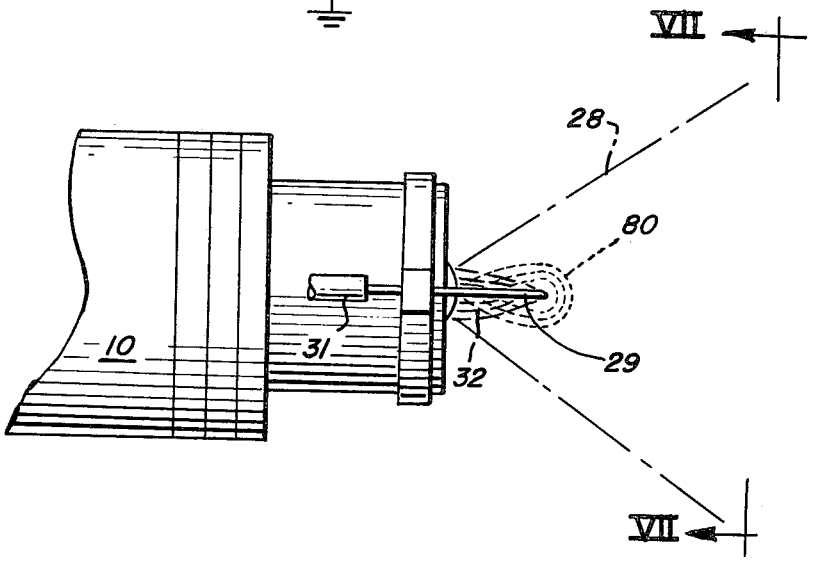
FIG. 6 is a plan view of the end portion of the gun of FIG. 5 taken along line VI—VI of FIG. 5.

Preferred geometry for the hydrostatic gun is illustrated in FIGS. 5, 6 and 7. The hydrostatic painting gun 10 preferred for coating the tubes illustrated in FIGS. 1 and 4 has an internal preorifice 85 with a circular opening of 0.33 mm (0.013 inch). The nozzle orifice 87 is an oval opening with a circular equivalent of 0.28 mm (0.011 inch). The major axis of the nozzle opening is horizontal. The paint particles form a fan-shaped pattern 28 having a vertical angle of the order of 10° and a horizontal angle of the order of 80°. The paint pattern at a distance of 0.4 m (16 inches) from the nozzle is approximately 50 mm (2 inches) high and 250 to 300 mm (10 to 12 inches) wide.

The electrode 29 is of 0.74 mm (0.029 inch) wire and extends forward of the face of the gun a distance of the order of 12 to 25 mm (0.5 to 1.0 inch). The tip 34 of the electrode is spaced from the concentrated paint particle zone less than 12 mm (0.5 inch).

Suitable voltages are 15 kv negative on the paint charging electrode, 100 kv positive on the articles being painted with a minimum gun-to-article spacing of the order of 0.4 m (16 inches).

In the installation for coating tubes having attached flanges, two guns are located on the reciprocator arm, spaced 1.8 m (6 feet) apart. (Additional guns could be used where the articles being painted require more paint.) The conveyor rack moves through the paint booth at a height of the order of 4 m (14 feet) above the floor. The hook hangs downwardly from the rack a little more than 0.3 m (1 foot) and the tubes are about 2 m (6 feet) long so that they clear the floor by about 0.6 m (2 feet). The racks are 0.6 m (2 feet) in diameter and spaced apart on 1 m (3 foot) centers allowing sufficient distance between them to accommodate the irregular shapes of the tubes, portions of which extend outside the rack periphery. The racks rotate 360° with conveyor travel of one foot.

In typical operation the conveyor moves at 0.6 m (2 feet) per minute and the reciprocator completes several cycles of up and down movment as each article is in the coating area of the two guns.

The system disclosed has been found to achieve unusual results in providing complete and uniform coverage when used to coat articles having an irregular surface as with recesses and sharp edges, and with large gun-article spacing. Irregular surfaces are difficult to coat with prior electrostatic systems, even at close distance, as charged particles tend to deposit before entering a recess and sharp edges are heavily coated, robbing paint from adjacent surfaces.

It is our theory that the divorced electrode gun 10 operated as described herein imparts charges of differing polarity and strength to the paint particles. This variety of particle charge together with the electric field of the large charged article improves the coating of irregular surfaces.

The electric field conditions in the gun will be considered first, assuming the system parameters already described. Electrode 29 has a negative charge of 15 kv and electric field 32 extends from the electrode to nozzle 33 and the grounded stream of conductive paint. Field 32 induces a positive surface charge on the paint at the nozzle. Although water-borne paint has low resistance, the paint stream is partially broken up when it is forced through preorifice 85 and there is sufficient resistance from the nozzle to ground that the surface charge is not dissipated by conduction. Thus, the paint particles discharged from nozzle 33 have an induced positive charge which is relatively uniform. Where the paint has sufficient resistance, the preorifice is not necessary to achieve particle charging, although it may be used to improve uniformity of particle size and thus the quality of the finish on the article being painted. With paint having a nonconductive solvent, a ground connection to the paint stream is necessary. Grounded probe 88 is provided, extending into the paint stream in chamber 86, between preorifice 85 and nozzle 33, for example.

The pointed tip 34 of electrode 29 provides a source for a corona discharge. The electrons discharged from the tip ionize the surrounding atmosphere to form a dense population of negatively charged oxygen molecules ($O_2^-$) in the zone 80. Other constituents of air are less susceptible than oxygen to ionization and we believe they are not significant in the particle charging action. The $O_2^-$ ions propagate generally outwardly from tip 34 and are biased toward the positively charged nozzle so that zone 80 is not spherical about the tip. The density of the ions is greatest at the electrode tip and diminishes with increasing distance therefrom.

The paint particles as they are discharged from the orifice 87 have a net positive surface charge, induced by the field 32. The magnitude of the positive charge on the particles is determined by the strength of field 32, such strength being a function of electrode charge, distance and conductivity of the medium between the electrode and tip 33, and conductivity of the paint between the tip and ground.

After the particles with an induced positive charge are atomized from the nozzle tip, they are mechanically directed towards the article 35 by the high pressure of the paint stream. With the oval aperture of nozzle 33, the particles form a generally flat fan-shaped pattern 28. As illustrated in FIGS. 5, 6 and 7, the particles in the center of the spray pattern pass through the portion of zone 80 containing relatively high density of $O_2^-$ ions. The $O_2^-$ ions are attracted to the positively charged particles, and upon attachment tend to neutralize the positive surface charge. As additional $O_2^-$ ions collide with the particle, the initial positive polarity of some particles is reversed and such particles carry a net negative charge as they proceed toward the article.

Other particles discharged from the nozzle are spaced laterally away from the center of the spray pattern and pass through a portion of zone 80 containing fewer $O_2^-$ ions. With fewer ions available for attachment, fewer negatively charged particles and a higher proportion of neutral particles (or particles weakly charged) will be produced. Neutral particles, although they have no net surface charge, may have a significant dipole moment and will be polarized by and attracted to a charged article of either polarity. Paint of low conductivity, e.g., hydrocarbon or dionized water solvent, is more susceptible to polarization deposition than conductive paint.

The remaining particles are directed from the nozzle to the article such that they do not pass through ionized zone 80. Particularly, droplets in the laterally outer portion of the fan-shaped spray pattern 28 will be least influenced by the $O_2^-$ ions and will retain their initially induced positive charge.

The paint particles have differing states of charge and polarity as they approach article 35. Particles in the central portion of the zone 28 will tend to be the most strongly negatively charged, while those in the laterally outer portions of the zone will tend to retain the greatest amount of positive charge. Particles between the center and outer portion will be at some intermediate charge state.

Reversing the polarity on the electrode and the article yields similar results since the charging mechanisms produce particles having an initially induced negative charge that is subsequently bombarded by $O_2^+$ ions. In either case, three species of charged particles are directed toward a charged article. Further, since the charges on the particles are not of a large magnitude, and plural species of the particles are produced by either a positive or negative charge on the electrode, the polarity at either the electrode or the article is not critical. It has been found that articles are electrostatically coated at distances up to about 2.5 m (8 feet) with any combination of polarities including like polarity on both the electrode and article.

Since the paint is directed to the charged article from a gun mounted on a reciprocator, all species of charged particles are presented to every point on the article at some time during the painting cycle. The prior art teaches that normally particles oppositely charged with respect to the article exhibit wrapping and deposition but will not penetrate recesses due to high attraction to the highly charged edges of such recesses. Neutral particles exhibit better penetration of recessed areas with acceptable wrapping characteristics.

Particles having the same polarity as the article are slowed as they approach the article surface due to interaction of their respective like charges. However, since the particle charge is relatively weak with respect to the article charge, the momentum of the particle, particularly with hydrostatically atomized particles, is generally sufficient to resist repulsion once the particle is directed toward the article. It has been found that this species is resistant to deposition on a highly charged edge surrounding a recess and will usually penetrate the recess to a much greater extent than the oppositely charged or neutral particles.

Variations in the nozzle and electrode geometry which produce plural species of particles are possible. For example, a rounded or spherical electrode will also produce a corona discharge if a suitable point or sharp edge is provided on the nozzle. Likewise, multiple electrodes spaced from the nozzle and from each other will establish multiple ionized zones to provide multiple species of charged particles.

Once a particle has been charged by $O_2$ ion bombardment, it is believed that polarity reversal by subsequent ion bombardment, such as occurs in the region of a point or sharp edge on the charged article, is inhibited by the inability of the particle to accept additional attachments. In any event, the system and method achieve efficient and complete coating of a charged article with an irregular surface and it is believed that the presence of diversely charged particles is a major factor in accomplishing this result.

Further, it has been observed that particles charged with a divorced electrode are less prone to drying before reaching the article than are particles in a nonelectrostatic system. It is believed that the attachment of $O_2$ ions to the particle surface is instrumental in inhibiting evaporation of the solvent. Since the surface charge state is a function of the particle evaporation state, a second benefit is realized in that the particle is thus able to maintain a given surface charge for a longer time period.

With the present invention, large irregular objects such as engines or large tractors may be automatically painted electrostatically in an economic manner.

Nonconductive articles are satisfactorily painted electrostatically in a system using conductive paint, where the article is charged. A charged nonconducting article acts as a voltage divider and a significant electric field exists if the article is not close to a grounded surface. The electric field is sufficient to deposit some paint which serves as a conducting surface on the nonconductor whereupon the field rapidly increases in strength until it is comparable with the field around a conducting article. This eliminates the need for prepainting treatments often used in coating nonconductors.

What is claimed is:

1. An electrostatic painting apparatus (10) for painting an article (35) with a liquid paint, comprising:

first means (15,12,27,33) for projecting the paint in a plurality of atomized particles in a preselected spray pattern (28), the first means (15,12,27,33) including a gun body (27) and a nozzle (33) connected to the gun body (27); and second means (30,29) including an electrode (29) for establishing an electric field (32) between the nozzle (33) and the electrode (29), imparting an initial electrical charge of one polarity to the plurality of atomized particles at the nozzle (33), establishing a zone of ions (80) of an opposite polarity to said one polarity in the pathway of the preselected spray pattern (28) issuing from the nozzle (33), and neutralizing and reversing the polarity of a portion of the charged particles and providing a plurality of diversely charged particles.

2. The electrostatic painting apparatus (10) of claim 1 wherein the second means (30,29) includes a power supply (30) having a negative terminal connected to the electrode (29).

3. The electrostatic painting apparatus (10) of claim 1 wherein the electrode (29) has a negative charge sufficient for inducing a positive charge substantially solely on the nozzle (33).

4. The electrostatic painting apparatus (10) of claim 1 including third means (85,86) for partially breaking up the paint at a location upstream of the nozzle (33).

5. The electrostatic painting apparatus (10) of claim 4 wherein the third means (85,86) includes a preorifice (85) and a chamber (86) upstream of the nozzle (33).

6. The electrostatic painting apparatus (10) of claim 1 including an electrical ground (20) and resistor means (88) for establishing a preselected resistance between the nozzle (33) and the ground (20), the nozzle (33) being exposed to the electrical charge by the second means (30,29) and being otherwise electrically isolated except for an electrical path through the paint to the ground (20) through the resistor means (88).

7. The electrostatic painting apparatus (10) of claim 1 wherein the electrode (29) has an electrode tip (34), and the preselected spray pattern (28) is of a generally flat expanding fan pattern of paint particles, the electrode tip (34) being spaced a distance less than one-half inch from the pattern (28) at an electric potential in the order of about 15 kilovolts.

8. In an electrostatic paint gun (10) of the type utilizing a pressurized source (15,12) of fluid paint and a nozzle (33) for atomizing and delivering paint in a plurality of particles having a fan-shaped spray pattern (28), the improvement comprising:

an electrode (29) having a distal end (34) spaced a preselected distance away from the spray pattern (28) and the nozzle (33); and means (30,31) for imparting a negative charge to the electrode (29) sufficient for establishing an electric field (32) between the nozzle (33) and the electrode (29), inducing a positive charge to the nozzle (33) and to the plurality of paint particles initiating therefrom, and for establishing a corona (80) of negative ions downstream of the nozzle (33) sufficient for neutralizing and reversing the polarity of a preselected portion of the positively charged particles in the spray pattern (28) and providing a plurality of diversely charged particles.

9. An electrostatic painting gun (10) comprising:

an annular body (27) having a first orifice (85) and an internal chamber (86);

a nozzle (33) having a second orifice (87) in communication with the internal chamber (86), the nozzle (33) being connected to the body (27);

means (15,12) for hydrostatically urging paint through the first orifice (85), the chamber (86) the second orifice (87), and out the nozzle (33) in a spray pattern (28) of paint particles;

an electrode (29) having a distal end (34) spaced a preselected distance from the nozzle (33) and being connected to the body (27);

an electrical reference potential (20); and voltage means (30,31) connected to the electrode (29) for establishing an electric field (32) between the nozzle (33) and the electrode (29), inducing an electrical charge on the nozzle (33) of opposite polarity to that of the electrode (29) and a preselected current flow through the paint in the chamber (86) to the electrical reference potential (20), imparting a charge of one polarity to the paint particles at the nozzle (33), and for establishing a zone of ions (80) in the pathway of the spray pattern (28) sufficient for neutralizing and reversing the polarity of a portion of the paint particles.

10. A system for electrostatic coating of an article (35) with paint, comprising:

atomizing gun means (10,12,15) for projecting the paint toward the article (35) in a plurality of atomized particles, the gun means (10,12,15) having a nozzle (33);

an electrode (29) spaced from the nozzle (33) a preselected distance;

first voltage source means (30,31) connected to the electrode (29) for establishing an electric field (32) between the nozzle (33) and the electrode (29), imparting an initial electrical charge of one polarity to the particles at the nozzle (33), establishing a zone of ions (80) of opposite polarity subsequently effective to neutralize and reverse the polarity of a portion of the particles, and providing a plurality of diversely charged paint particles; and second voltage source means (40,36) connected to the article (35) for influencing the path of travel of the diversely charged paint particles.

11. The system of claim 10 including an electrical ground (20) and means (27,85,86) for breaking up the paint stream prior to reaching the nozzle (33) and establishing a preselected electrical resistance from the nozzle (33) to the electrical ground (20).

12. The system of claim 10 including an electrical reference potential (20), and wherein the electrical charge at the electrode (29) is at a DC potential relative to the reference potential (20) of about 15 kilovolts and the article (35) is at a DC potential relative to the reference potential (20) of about 100 kilovolts.

13. An electrostatic painting apparatus for painting an article (35) with liquid paint, comprising:

a nozzle (33);

first means (15,12) for ejecting the paint from the nozzle (33) in a preselected stream pattern (28) of atomized particles;

second means (29,30) including an electrode (29) spaced a preselected distance away from the stream pattern (28) for establishing an electric field (32) between the nozzle (33) and the electrode (29), for electrically charging the particles at the nozzle (33) and providing a charged stream pattern (28), establishing a zone of ions (80) intersecting the charged stream pattern (28), neutralizing and reversing the charge of some of the particles and providing a plurality of diversely charged particles; and third means (40,36) for electrically charging the article (35) and attracting the plurality of diversely charged particles along different individual paths.

14. The electrostatic painting apparatus of claim 13 including means (85,86) providing a preselected electrical resistance and a path upstream from the nozzle (33) through the paint to an electrical ground (20).

15. The electrostatic painting apparatus of claim 13 wherein the second means (29,30) includes means for charging the electrode (29) at about 15 kilovolts, and the third means (40,36) includes means for charging the article at about 100 kilovolts.

* * * * *